US009630340B2

(12) United States Patent
McCary, Sr.

(10) Patent No.: US 9,630,340 B2
(45) Date of Patent: Apr. 25, 2017

(54) SYSTEM OF FORMING WALLS WITH EXTERIOR APPLIED FINISH PANELS

(71) Applicant: John Milner McCary, Sr., Birmingham, AL (US)

(72) Inventor: John Milner McCary, Sr., Birmingham, AL (US)

( * ) Notice: Subject to any disclaimer, the term of this patent is extended or adjusted under 35 U.S.C. 154(b) by 44 days.

(21) Appl. No.: 14/544,257

(22) Filed: Feb. 6, 2015

(65) Prior Publication Data

US 2016/0230406 A1 Aug. 11, 2016

(51) Int. Cl.
*B28B 1/14* (2006.01)
*B28B 7/00* (2006.01)
*E04G 9/10* (2006.01)

(52) U.S. Cl.
CPC ..... *B28B 1/14* (2013.01); *B28B 7/007* (2013.01); *B28B 7/0073* (2013.01); *E04G 9/10* (2013.01)

(58) Field of Classification Search
CPC ..... B28B 7/007; B28B 7/0073; B28B 1/14; E04G 17/047; E04G 9/10
USPC ..... 264/31, 35; 249/15, 16; 52/442
See application file for complete search history.

(56) References Cited

U.S. PATENT DOCUMENTS 788,391 A * 4/1905 Bovee ..... E04G 9/10 249/15
826,878 A * 7/1906 Pegram ..... E04G 9/10 249/16
843,956 A * 2/1907 Martin ..... E04G 17/06 249/15
1,776,999 A * 9/1930 Jensen ..... B28B 7/007 156/61
2,954,645 A * 10/1960 Bennett, Jr. ..... E04H 4/0087 264/279
4,158,082 A * 6/1979 Belousofsky ..... B63B 5/20 114/357
5,009,387 A * 4/1991 Scott ..... B28B 19/0061 249/112
5,375,809 A * 12/1994 Goto ..... E04B 2/8647 249/16
5,667,190 A * 9/1997 Scott ..... B28B 19/0061 249/16
6,257,545 B1 * 7/2001 Tokita ..... B28B 19/0061 249/15
2015/0184388 A1 * 7/2015 Ciuperca ..... E04B 1/355 52/745.11
2015/0337548 A1 * 11/2015 Ciuperca ..... E04G 17/047 264/35

* cited by examiner

*Primary Examiner* — Michael Safavi

(57) ABSTRACT

A system used to form poured walls or structures with a finished surface which may be smooth, various pattern surfaces such as brick or stone or applying thin material, such as thin brick and thin stone, using exterior applied finish panels which are attached by attaching means, grapple catches, to the exterior face of a concrete/cementous material flow through lattice grid form as one or both forming surfaces in a concrete/cementous pour. When the forms are poured concrete/cementous material flows through the lattice grid panel and flows up to the interior forming face of the exterior applied finish panel. When the concrete hardens to the desired stiffness the exterior applied finish panel is removed the pattern or thin material remains on the exterior formed face and where the thin material holding gaskets were located now represent the thin material surrounding concrete/cementous material mortar joints.

2 Claims, 5 Drawing Sheets

SYSTEM OF FORMING WALLS WITH EXTERIOR APPLIED FINISH PANELS

CROSS-REFERENCED TO RELATED APPLICATIONS

This application makes reference to U.S. application Ser. No. 13/385,676 filed Jan. 1, 2012.

FIELD OF THE INVENTION

This invention relates to a system using flowing concrete or other cementous material to form poured concrete structures with an external surface finish. This invention relates to the concrete/cementous material flow through a lattice grid panel of a concrete form creating a flow through concrete accumulation on the external surface of the panel to enable exterior applied finish panels to produce smooth, various patterns and/or decorative finish to the hardened dry exterior concrete/cementous concrete layer.

BACKGROUND OF THE INVENTION

The process of constructing a poured concrete wall or structure has conventionally required forms to be created on site or at non-construction site location, wherein the concrete forms may consist of wood, metal, plastic or wood/metal panels when the poured wall are constructed on site the forms are erected and maintained in spaced, parallel relationship with other panels. Fluid concrete is poured within the concrete forms, which are removed after the concrete has set and hardens. When the poured walls are produced off site individual wall sections are poured and then transported to the construction site.

If decorative and/or finish treatment can be applied on the face of the poured concrete surface increased value and attractive looks can be added to a structure. Time and expenses can be saved in troweling and decorative treatment of concrete walls when these activities can be performed near the same time as pouring and there is an adequate workable concrete layer on the exterior face of the poured concrete wall. An example of exterior facial treatment in one segment of the poured concrete wall industry is in tilt-up construction. In tilt-up wall construction walls are poured as a horizontal concrete slab, cured and then a crane is used to place the panel in place. In most pours the exterior face of the panel is poured first, face down. Tilt-up surface finishes include single and multi-use form liners, placed on the pouring surface or "bed" before the panel is poured, creating various patterns and textures to the exterior concrete surface. Also there are many color variations of stains and epoxy paints that can be applied to the exposed facial concrete surface. The speed to erect walls and to provide decorative facial finished in tilt-up construction enables tilt-up to be very competitive in larger "Big Box' style structures such as lager stores, warehouses or distribution centers. The cost to crane lift the tilt-up slab wall in place is expensive and the architectural style and look of tilt-up structures is fairly limited due to the nearly flat repeated slab panel construction.

Another example of form liner usage in concrete wall pours is where the form liner is attached to the forming face or interior surface of a vertical wall concrete form before pouring. After the concrete vertical form is poured and hardened to the desired stiffness the form panels are removed and the form liner is stripped off.

SUMMARY OF THE INVENTION

This invention is a poured concrete wall/structure forming system utilizing flowable concrete or cementous material mixture to construct the concrete or cementous structure using concrete/cementous material flow through lattice grid forms and applying exterior applied finish panels to the lattice grid forming panel external face. The forming system comprises having at least one concrete/cementous material flow through lattice framework panel having a plurality of openings throughout and a second panel or surface where the two panels are spaced apart in a parallel relationship. The two forms are connected together or held spaced apart by a number of cross connecters/webs. An "exterior applied finish panel" is attached to the outside face of the forming lattice grid from. The exterior applied finish panel is attached to the flow through lattice panel by grapple catches. The grapple catches have circular insert slots that various length bolts or screw can attach to the grapple catch. Specifically placed holes are made though the exterior applies panels in which the grapple catch bolts or screws are placed though and the grapple catches are then placed through the grid openings of the lattice grid panel. The grapple catch arms then expand out catching the interior surface of the panel grid to the holding the exterior applied panel securely to the flow through lattice form. Various lengths of the grapple catch bolts or screws can determine the distance from the lattice form exterior face and the forming face of the exterior applies panel.

The exterior applied finish panel may be made of wood, wood composites, plywood, elastomeric urethane rubber, plastic, polystyrene or polypropylene foam and/or fiberglass depending on the pattern, the number of times that the form liner can be used and the application. The interior forming face of the exterior applied finish panel may have a smooth face, brick, rock, stone or any other forming pattern.

Concrete/cementous material is poured into the cavity between the two spaced apart forming panels. The concrete flows around and through the cross member connecters/webs and also through the opening of the lattice panel(s) such that the concrete extends beyond the external surface of the lattice grid panel exterior surface. The flow through concrete/cementous material flowing through the lattice grid form panel fills the space between the exterior face of the lattice grid panel and the exterior applied finish panel. Screeds extending out approximately ¼ to ½ inch from the exterior face of the lattice grid forming panel usually touch the exterior applied finish panel forming face, with the screeds helping to keep the exterior applied finish panel from resting against the lattice panel grids and the screeds assist in maintaining that there is adequate flow through concrete/cementous material between the lattice grid face and the exterior applied finish panel forming face. Sometimes the concrete between the pour forms is vibrated to help fill any air voids in the poured concrete/cementous material.

Once the concrete/cementous material sets up to an adequate stiffness the grapple catch bolts are removed and the exterior applied finish panels are removed at a designed time when the concrete/cementous material reaches the desired stiffness. Decorative treatment can be applied to the exterior concrete/cementous of the exterior applied finish panel formed surface Another important embodiment entails placing thin brick, thin block or thin stone in exterior applied gasket holding finish panels and attaching the gasket holding exterior applied panels to the exterior face of the forming lattice grid panel before pouring. Here again the grapple catches are used to attach the thin brick, thin block, thin stone or other gasket held material exterior applied finish panel to the lattice grid form. Concrete/cementous material is poured into the cavity between the two spaced apart forming panels. The concrete flows around and through the cross member connecters/webs and also through the opening of the lattice panel(s) such that the concrete extends beyond the external surface of the lattice grid panel exterior surface. The flow through concrete/cementous material flowing through the lattice grid form panel fills the space between the exterior face of the lattice grid panel and the forming face of the gasket holding thin material exterior applied finish panel. Screeds extending out approximately ¼ to ½ inch from the exterior face of the lattice grid forming panel usually touch and help hold in place the thin material held in the gasket holding exterior applied finish panel forming face, and the screeds assist in maintaining that there is adequate flow through concrete/cementous material between the lattice grid face and the gasket holding thin material exterior applied finish panel forming face. Sometimes the concrete between the pour forms is vibrated to help fill any air voids in the poured concrete/cementous material.

Once the concrete/cementous material sets up to an adequate stiffness the grapple catch bolts are removed and the exterior applied finish panels are removed at a designed time before the concrete dries. The exterior applied gasket held thin material, including thin brick, thin block and thin stone, remains embedded in the lattice grid form flow through concrete/cementous material with the places where the exterior applied panel holding gaskets were now look like and represent mortar joints surrounding the embedded thin material. Decorative treatment can be applied to the exterior applied gasket held thin material and the concrete/cementous material mortar joint

DETAILED DESCRIPTION OF THE PREFERRED EMBODIMENTS

Figure 1:
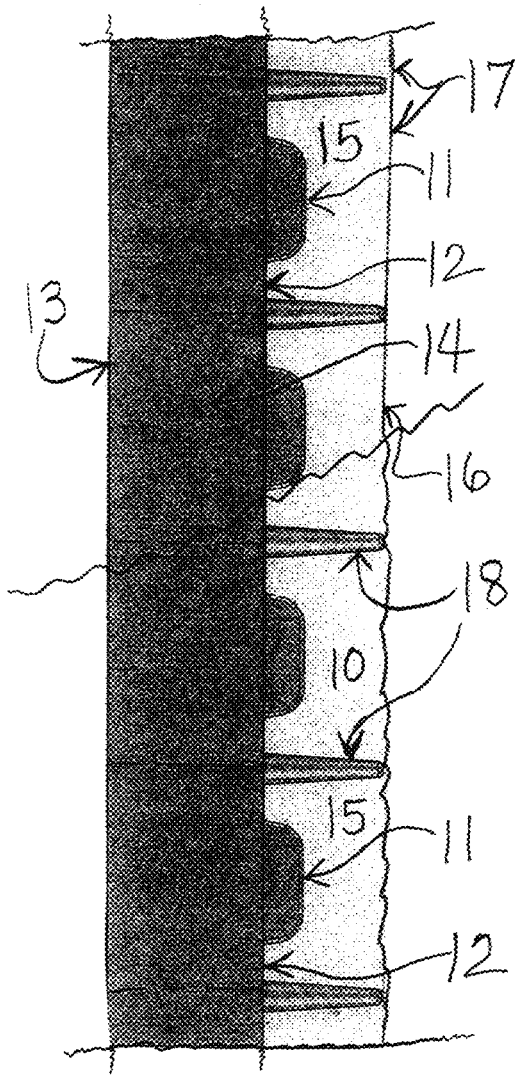
FIG. 1 shows in a cross-sectional side view of concrete or cementous material flowing through the lattice grid panel out to the attached form liner forming face with a grapple catches attaching the exterior applied finish panel to the lattice grid form.

FIG. 1 shows in a cross-sectional side view concrete or cementitious material flow through lattice grid form 11, the grapple catch head 12 and grapple catch bolt or screw 13 that attach the exterior applied finish panel 14 to the lattice grid form. The interior forming face 15 of the exterior applied finish panel has a rock pattern interior forming face 16. Concrete/cementitious material 17 flows through the lattice form flowing up to the interior forming face of the exterior applied finish panel. Screed points 18 attached to the exterior face 19 of the lattice grid form 11 help hold the exterior applied finish panel away from the exterior face of the lattice grid form, allowing the concrete/cementitious material 17 to accumulate between the lattice grid form exterior face and the interior forming face 15 of the exterior applied finish panel.

Figure 2:
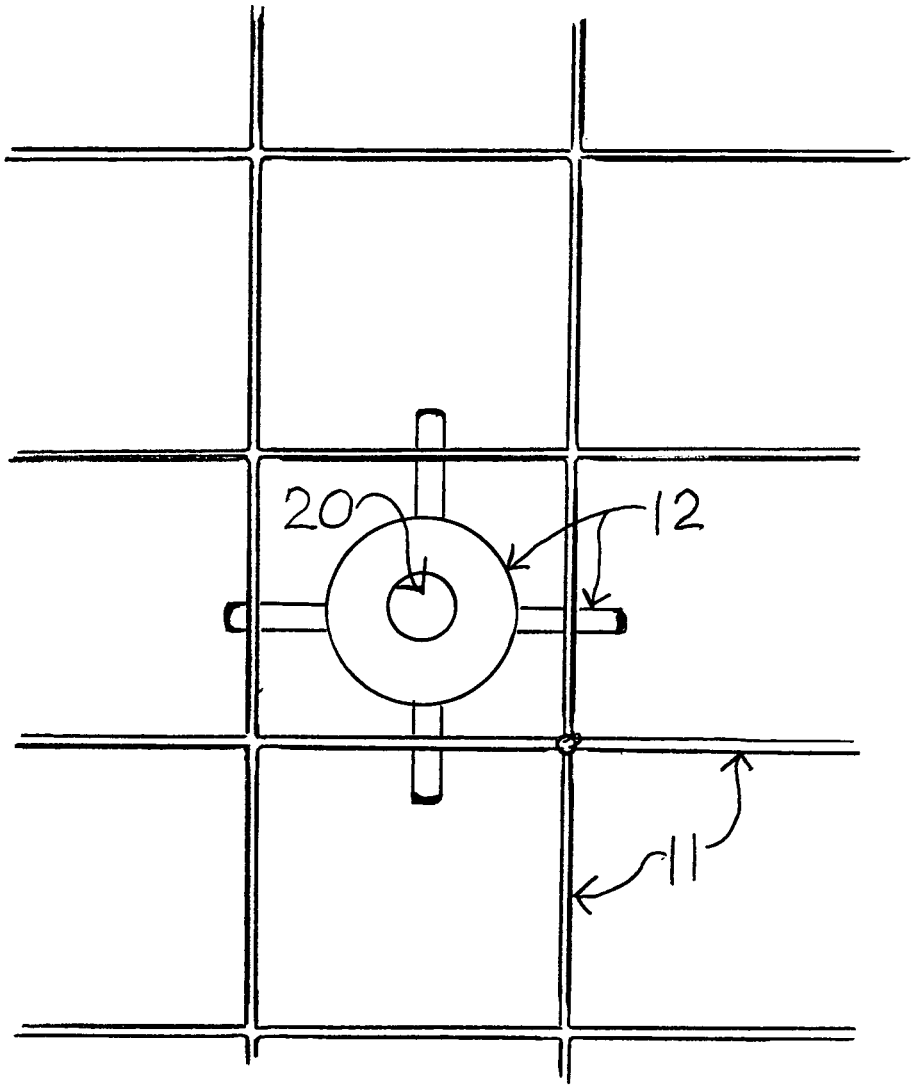
FIG. 2 in a rear perspective view shows the grapple catch head with the grapple catch head circular bolt or screw insert slot.

FIG. 2 in a rear perspective view shows the grapple catch head 12, catching lattice grids of the lattice grid form 11, and also showing screed points 18. Also shown is the bolt or screw circular insert slot 20 of the grapple catch head 12.

Figure 3:
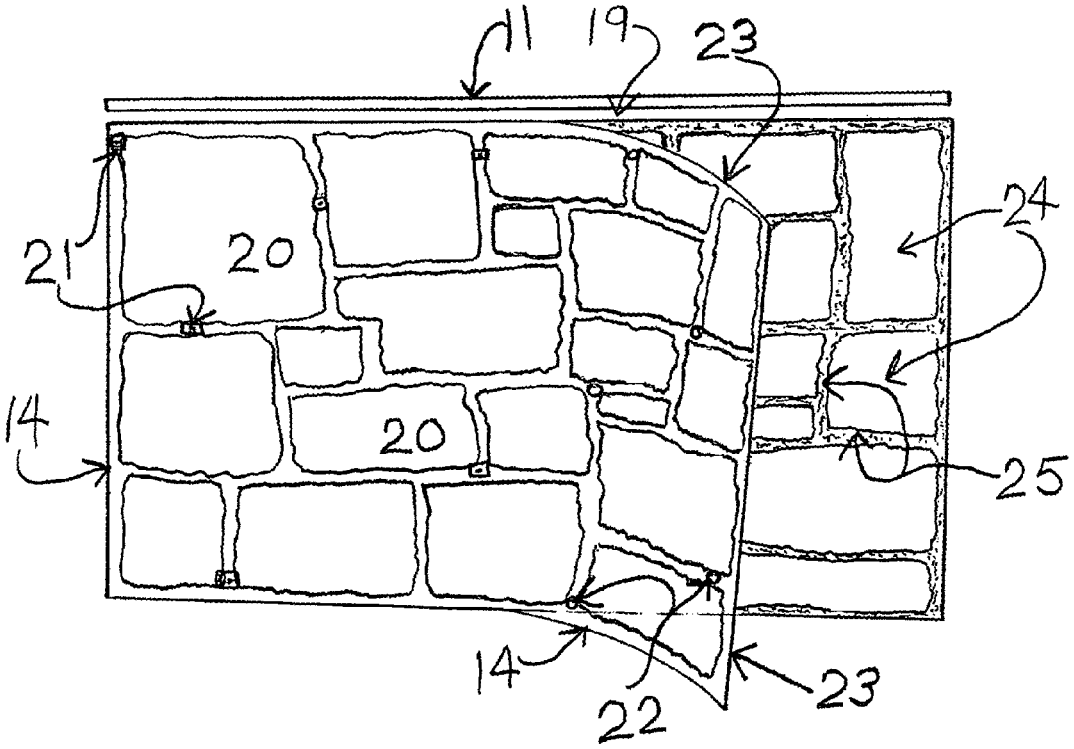
FIG. 3 is a perspective view of an exterior applied finish panel with a stone pattern, being removed from the exterior face of the concrete/cementous material flow through lattice form.

FIG. 3 in a perspective view showing an exterior applied finish panel with a stone pattern forming face 16, grapple catches 21 and grapple catch attaching holes 22 through the exterior applied finish panel. Also shown is the exterior applied finish panel being removed 23 from the exterior face 19 of the concrete/cementitious material flow through lattice form 11 with the finish concrete/cementitious material formed stone pattern face 24 with concrete/cementitious material mortar joints 25.

Figure 4:
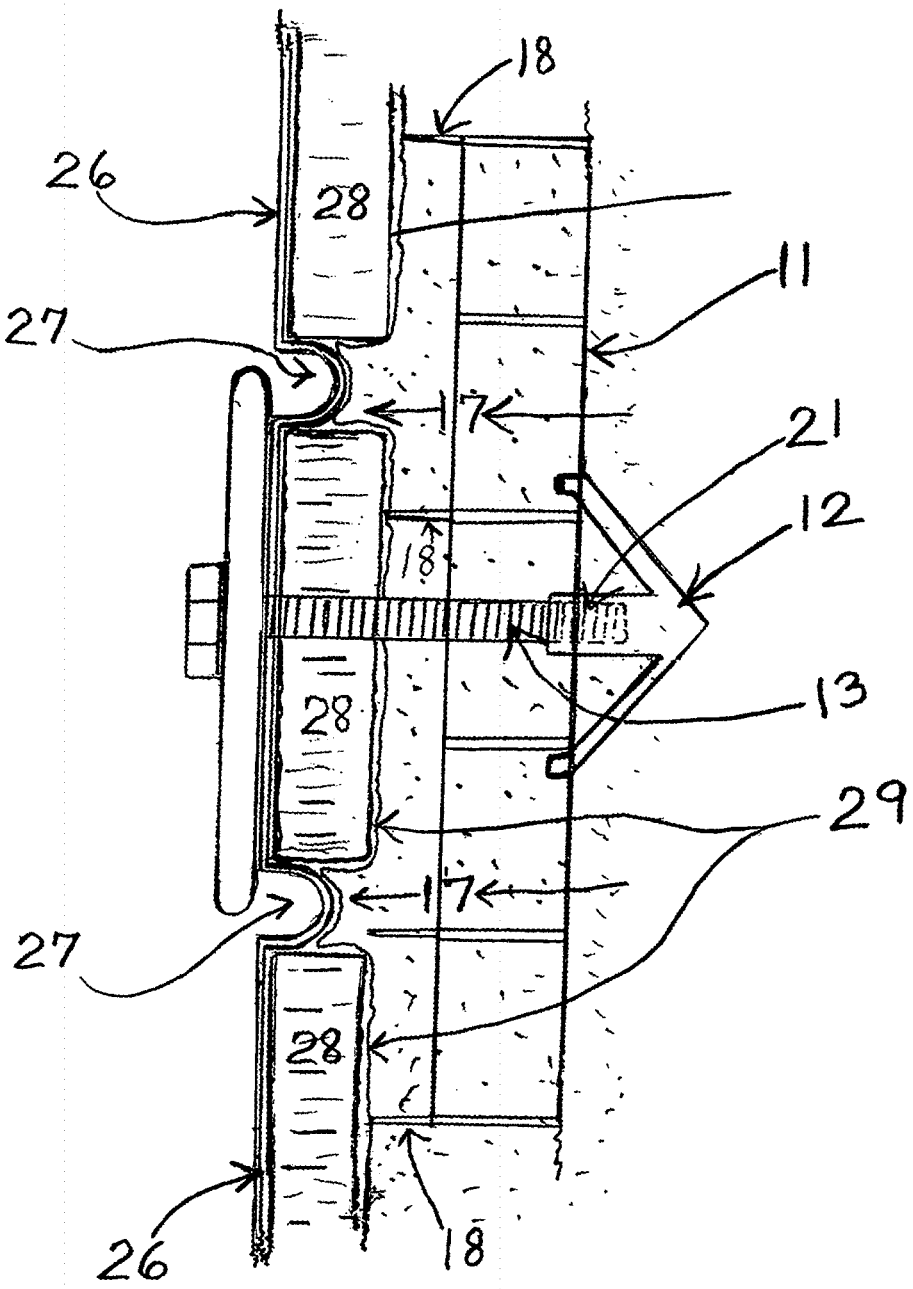
FIG. 4 shows in a side perspective view a concrete/cementous material lattice grid form with a gasket holding exterior applied finish panel with gasket held thin brick attached by the grapple catch to the exterior face of the lattice grid form.

FIG. 4 shows in a side perspective view a concrete/cementitious material lattice grid form with a gasket holding exterior applied finish panel 26 with the exterior applied finish panel gasket 27 held thin brick 28 attached by the grapple catch 21, with grapple catch head 12 attached over the lattice form grid, the grapple catch bolt or screw 13 running through the gasket holding thin material brick exterior applied exterior applied panel to the exterior face 19 of the lattice grid panel. Form poured concrete/cementitious material 17 is shown flowing through the lattice grid form up to the back or none-face side 29 of thin brick 28 and the thin brick gaskets 27 holding the thin brick of the exterior applied finish panel. Also shown is the back or none-face side 29 of thin brick 28 resting against screed points 18.

Figure 5:
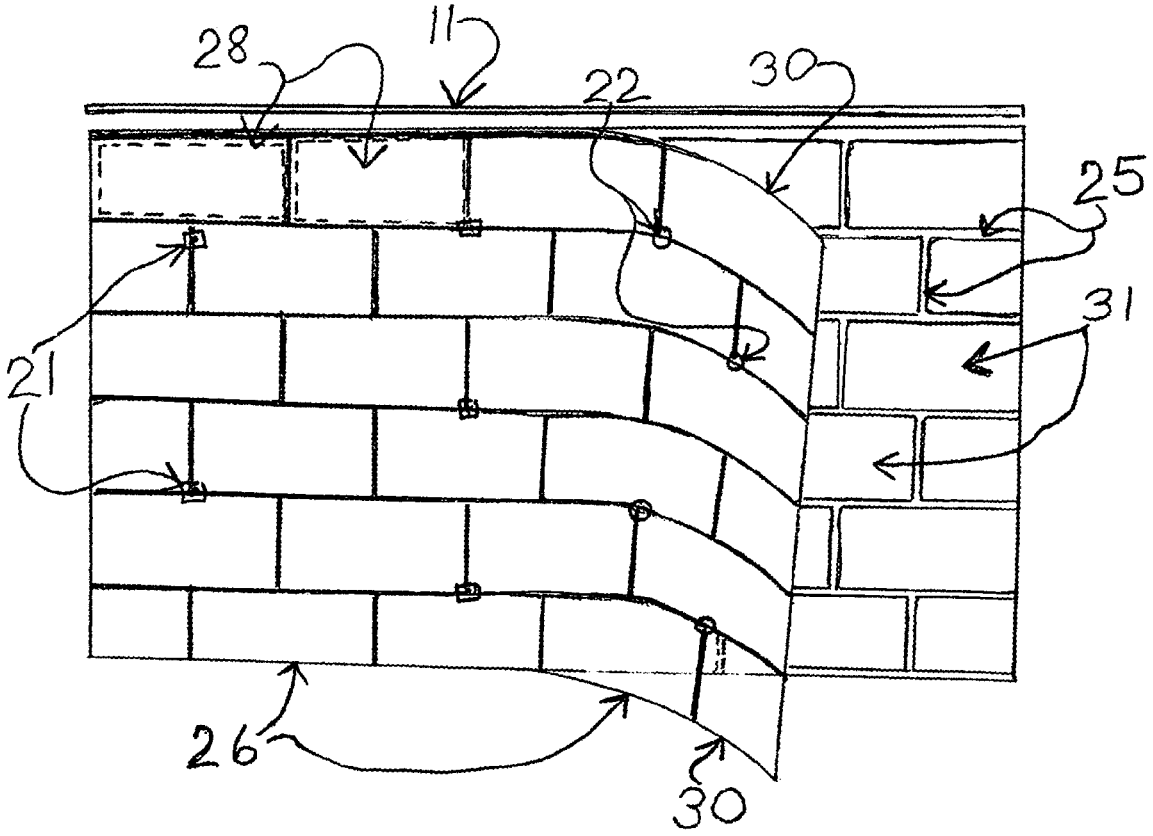
FIG. 5 is a perspective view of a gasket holding exterior applied finish panel, holding thin bricks, being removed showing the front face of the thin bricks and the concrete/cementous material mortar joints.

FIG. 5 is a perspective view of a gasket holding exterior applied finish panel 26, holding thin bricks 28, partially attached to the lattice grid form 11 by grapple catches 21, the thin brick gasket holding exterior applied finish panel 26 being detached 30 from the lattice grid form, with grapple catch exterior applied finish panel attaching holes 22 showing the front face 31 of the thin bricks and the concrete/cementitious material mortar joints 25.

The invention claimed is:

1. A method of forming concrete/cementitious material structures with an exterior surface finish comprising the steps of:

a. assembling concrete/cementitious forms, as by assembling concrete/cementitious forming panels with at least one of the forming panels being a lattice grid forming panel having a plurality of grid openings there through, and installing an opposing lattice grid forming panel, attaching a plurality of connecting or spacing members securing or separating said first lattice grid form to the opposing lattice grid forming panel in a spaced relationship such that a cavity is formed between said first lattice grid forming panel and the spaced apart opposing lattice grid forming panel, for receiving a flowable concrete/cementitious material mixture therein;

b. placing an exterior applied form liner panel upon screed points of the exterior face of the lattice grid forming panels wherein the interior forming face of the exterior applied form liner panel may have a smooth face, brick, rock, stone pattern forming face, or other forming pattern;

c. pushing a grapple catch, with a bolt or screw attached to the grapple catch via an attaching circular insert of the grapple catch head, through holes in the exterior applied form liner panel or, the bolt or screw without an attached grapple catch head is first pushed through the exterior applied finish panel holes and then the grapple catch head is attached, thereafter the grapple catch is then pushed through the grid opening of the lattice grid panel with the grapple catch arms then expanding out to catch the interior edge of the lattice grid panel grid, holding the exterior applied form liner panel securely to the exterior face of the lattice grid panel;

d. the length of the bolt or screw attached into the circular insert of the grapple catch head is selected to determine the needed thickness of concrete/cementitious material between the interior finish forming face of the exterior applied form liner panel and the exterior face of the lattice grid panel, and;

e. introducing said flowable concrete into said cavity, wherein said flowable concrete fills said cavity non-restrictively through and around the connecting members/spacers, and extends through said grid openings through the lattice framework panels such that said flowable concrete extends beyond an external surface of the lattice panels such that the concrete/cementitious material substantially covers the interior forming face of the exterior applied form liner panel;

f. wherein the lattice grid forming panel screed points are attached to and extend out approximately ¼ to ½ inch from the lattice grid panel exterior grid face to thereby form a concrete layer between the exterior face of the lattice grid panels and the interior forming face of the exterior applied form liner panels when concrete/cementitious material flows through the lattice grid openings;

g. removing the exterior applied finish panel from the exterior face of the lattice grid panels when the concrete/cementitious material has stiffened to the desired hardness;

h. applying decorative treatment on the exterior applied form liner panel formed concrete/cementitious material face, and;

i. allowing said flowable concrete/cementitious material mixture to set, so that the concrete flowing through the lattice grid panels, including the concrete/cementitious material layer on the exterior surface of the lattice grid panel, and connecting members become a substantially monolithic structure when said flowable/cementitious mixture is set and hardens dry.

2. A method of forming concrete/cementitious material structures with an exterior surface finish comprising the steps of:

a. assembling concrete/cementitious forms, wherein concrete/cementitious forming panels are assembled where with at least one of the forming panels is being a lattice grid forming panel having a plurality of grid openings there through, and installing an opposing forming panel, which may be a lattice grid forming panel, and attaching a plurality of connecting or spacing members securing or separating said first lattice grid form to another the opposing lattice grid forming panel in a spaced relationship such that a cavity is formed between said first lattice grid forming panel and another the spaced apart opposing lattice grid forming panel, being spaced apart from the first lattice grid forming panel, for receiving flowable concrete/cementitious material mixture therein, and;

b. placing an exterior applied thin masonry brick/stone form liner panel, wherein an exterior applied thin masonry form liner panel is placed upon the exterior face of the lattice grid forming panel(s) panels with the exterior applied thin material form liner having thin masonry material holding sections that can hold thin masonry brick/stone material such as thin brick, thin block or thin stone, and;

c. pushing a grapple catch, wherein grapple catches, with an attached a bolt or screw attached into the grapple catch via an bolt or screw attaching circular insert of the grapple catch head, is pushed through formed or drilled through holes in the exterior applied thin masonry brick/stone form liner panel or, pushing the bolt or screw without an attached grapple catch head is first pushed through the exterior applied thin masonry brick/stone form liner panel made holes and then attaching the grapple catch head is attached to the bolt or screw, and pushing the grapple catch is then pushed through the grid opening of the lattice grid panel with the grapple catch arms then expanding out to catch the interior edge of the lattice grid panel grid, holding the exterior applied thin masonry brick/stone form liner panel securely to the exterior face of the lattice grid panel, and;

d. placing thin masonry brick/stone material into the holding sections of the exterior applied thin masonry brick/stone form liner with the interior face of the thin masonry material resting against the lattice grid panel screed points, and;

e. grapple catch bolt or screw length, wherein the length of the bolt or screw attached into the circular insert of the grapple catch head is selected to determine the needed thickness of concrete/cementitious material between the interior finish forming face of the thin brick/stone material placed in the thin masonry holding section of the exterior applied thin material form liner exterior applied form liner panel and the exterior face of the lattice grid panel interior face of the thin masonry material place in the thin masonry holding section of the exterior applied thin material form liner, and;

f. introducing said flowable concrete/cementitious material into said concrete/cementitious forming cavity, wherein said flowable concrete/cementitious material fills said concrete/cementitious material forming cavity non-restrictively through and around the connecting members/spacers, and extends through said grid openings of the lattice grid panel(s) panels such that said flowable concrete/cementitious material extends beyond the exterior face of the lattice panel(s) panels such that the concrete/cementitious material substantially covers the interior face of the thin masonry brick/stone material and the exterior face of the lattice grid panel interior forming face of the exterior applied thin masonry material form liner thin material holding section, and;

g. screed points, wherein by placing the thin masonry material in the exterior applied thin masonry form liner panel holding section with the interior face of the thin masonry thin material resting against the lattice grid panel screed points, that are attached to and extend out approximately ¼ to ½ inch from the lattice grid panel exterior grid face to thereby form a concrete layer is formed between the exterior face of the lattice grid panels and the interior face of the thin masonry brick/stone material when concrete/cementitious material flows through the lattice grid openings, and;

h. remove removing the exterior applied thin masonry brick/stone material form liner panel after the concrete/cementitious material has reached the desired hardness, with the thin masonry brick/stone material remaining embedded in the flow through concrete/cementitious material, and with the remaining concrete/cementitious material where the exterior applied thin masonry brick/stone form liner thin masonry brick/stone material holding sections were located and now removed, now represents representing concrete/cementitious material mortar joints surrounding the concrete/cementitious embedded thin masonry brick/stone material, and;

i. allowing said flowable concrete/cementitious material mixture to set, where so that the concrete/cementitious material that has flowed into the forming cavity, around the connecting members, through the lattice grid panel (s), including the concrete/cementitious material that has flowed up to and around the interior forming surface of the thin masonry brick/stone material, and the thin masonry brick/stone material become a substantially monolithic structure when said flowable/cementitious mixture is set and hardens dry.

* * * * *